US005897071A

United States Patent [19]

Hauck et al.

[11] Patent Number: 5,897,071

[45] Date of Patent: Apr. 27, 1999

[54] WIRE-COILING SYSTEM

[75] Inventors: Albert Hauck, Holchenbach; Siegfried David, Hilchenbach, both of Germany

[73] Assignee: SMS Schloemann-Siemag AG, Dusseldorf, Germany

[21] Appl. No.: 08/993,853

[22] Filed: Dec. 18, 1997

[30] Foreign Application Priority Data

Dec. 19, 1996 [DE] Germany ..... 196 53 063

[51] Int. Cl.[6] ..... B21C 47/10; B21F 3/00

[52] U.S. Cl. ..... 242/361; 242/361.4; 242/361.5; 140/124

[58] Field of Search ..... 242/361, 361.4, 242/361.5; 140/124

[56] References Cited

U.S. PATENT DOCUMENTS 3,669,377 6/1972 Gilvar et al. ..... 242/361

FOREIGN PATENT DOCUMENTS 1 814 280 7/1969 Germany .

229 314 11/1985 Germany .

*Primary Examiner*—John Q. Nguyen

*Attorney, Agent, or Firm*—Herbert Dubno; Andrew Wilford

[57] ABSTRACT

Wires are coiled by rotating about a main axis a curved laying tube having an upstream end opening generally at the axis and directed axially upstream and a downstream end opening radially offset from the axis and directed generally tangentially and feeding a leading end of the wire into the tube upstream end so that the wire issues from the downstream end of the tube in a curved condition and is laid in a succession of turns on a surface below the downstream end. Passage of a trailing end of the wire through the laying tube is detected and a drum having an inner surface directed toward and centered on the axis at the tube downstream end is closed around the downstream end of the tube to confine the wire inside the drum as passage of the trailing end through the laying tube is detected. The drum is opened from around the downstream end of the tube after passage of the trailing end through the tube and the drum is held open until detection of passage of another trailing end through the tube.

8 Claims, 1 Drawing Sheet

WIRE-COILING SYSTEM

FIELD OF THE INVENTION

The present invention relates to method of and apparatus for coiling a wire. More particularly this invention concerns a wire-coiling system that receives straight rod generally continuously and forms it into a succession of coils that are deposited on a surface.

BACKGROUND OF THE INVENTION

Wire or rod (hereinafter termed "wire" only) is formed at high speed in a rolling or drawing mill and is delivered in straight condition to a coiler that forms it into a succession of large-diameter turns that it deposits on a surface, normally a conveyor of some type. Thence the coiled wire is moved through subsequent treatment steps such as heat treatment, descaling, pickling, or simply cooling. It is critical that the wire be deposited in uniformly shaped and spaced coils so that the subsequent treatment stage is effective.

The typical coiling system comprises a so-called laying tube twisted in three dimensions and having an upstream end opening axially in line with an axis about which the tube is rotated and a downstream end which opens at a location radially offset from the axis and is directed generally tangentially. The straight wire is fed into the upstream end of the laying tube as it is rotated about its axis so that as the wire passes through the tube it is bent into an arcuate shape and will fall in a coil when leaving the downstream end of the tube.

Two main factors influence the operation of the coiler, wire diameter and wire speed. As wire diameter increases the friction inside the tube increases, creating substantial drag on the wire. As speed increases the wire is urged with greater centrifugal force against the inside wall of the tube so that once again friction inside the tube increases along with drag on the wire. Normally wire speed is, however, inversely related to wire diameter with thick wire moving much more slowly than thin wire. It is therefore standard to provide a drive engaging the rod just upstream of the upstream end of the laying tube to accelerate the trailing ends of thick wires and slow the trailing ends of thin wires, which may move at 100 m/sec.

The incoming workpiece is not endless and a problem occurs as the trailing end of a wire workpiece passes through the coiler. Due to the lack of upstream drag such a trailing end is likely to whip through the tube and not be sufficiently formed, that is to be laid on the conveyor in turns that are of excessive diameter. This can cause substantial problems so that frequently this section is cut away and must be recycled.

It has been suggested in German patent document 1,814,280 of G. Bollig to provide a bending roller at the downstream end of the laying tube which presses the exiting wire against the inner surface of a stationary laying drum coaxially surrounding the laying tube. This ensures accurate forming of like-diameter turns but represents extra equipment subject to substantial wear.

Old East German patent 229,314 of N. Brennecke proposes a complex control system that controls the rotation rate of the laying tube and the advance rate of the wire drive while monitoring the position of the wire end so that like-diameter turns are produced right to the trailing end of the wire. While relatively effective, this system is quite complex and not easily retrofitted to an existing wire mill.

OBJECTS OF THE INVENTION

It is therefore an object of the present invention to provide an improved wire-laying system.

Another object is the provision of such an improved wire-laying system which overcomes the above-given disadvantages, that is which is relatively simple but which ensures that right up to the end the wire is formed into like-diameter turns.

SUMMARY OF THE INVENTION

Wires are coiled according to the invention by rotating about a main axis a curved laying tube having an upstream end opening generally at the axis and directed axially upstream and a downstream end opening radially offset from the axis and directed generally tangentially and feeding a leading end of the wire into the tube upstream end so that the wire issues from the downstream end of the tube in a curved condition and is laid in a succession of turns on a surface below the downstream end. Passage of a trailing end of the wire through the laying tube is detected and a drum having an inner surface directed toward and centered on the axis at the tube downstream end is closed around the downstream end of the tube to confine the wire inside the drum as passage of the trailing end through the laying tube is detected. The drum is opened from around the downstream end of the tube after passage of the trailing end through the tube and the drum is held open until detection of passage of another trailing end through the tube.

Thus the trailing end of the wire, even if it has speeded up substantially because it is released from a drive upstream of the tube, is confined and accurately shaped into turns of the desired diameter. The drum is opened during normal operation so that it does not complicate or interfere with the bulk of the coiling operation. A controller is either programmed with or has sensors that determine the wire's advance speed and a sensor that determines when the trailing end of a wire workpiece leaves the furthest downstream forming (rolling or drawing) station. This time delay between when the controller detects that the trailing wire end has left the last forming station and when the drum is closed is in large part a function of wire travel speed.

In accordance with the invention as the wire exits from the drum it is impeded until the trailing end of the wire has left the downstream end of the tube. In addition the deposition surface is displaced horizontally as the wire turns are laid on it.

The coiling apparatus according to the invention thus comprises a curved laying tube having an upstream end opening generally at a main axis and directed axially upstream and a downstream end opening radially offset from the axis and directed generally tangentially, means for rotating the tube about the axis and a drive that feeds a leading end of the wire into the tube upstream end so that the wire issues from the downstream end of the tube in a curved condition and is laid in a succession of turns on a surface below the downstream end. A sensor detects passage of a trailing end of the wire through the laying tube. A closable and openable drum has an inner surface directed toward and centered on the axis at the downstream tube end. Actuators are provided for closing the tube around the downstream end of the tube and thereby confining the wire inside the drum as passage of the trailing end through the laying tube is detected and for opening the drum from around the downstream end of the tube after passage of the trailing end through the tube and maintaining the drum open until detection of passage of another trailing end through the tube.

The axis of the apparatus according to the invention is inclined downward from the tube upstream end and the drum includes a stationary large upper part, a pair of movable lower parts, and actuators for pivoting the lower parts between a closed inner position defining a radially outwardly closed space around the tube lower end and an open outer position in which the space is open downward toward the surface.

The large upper drum part in accordance with the invention extends over about 180° relative to the axis and each of the lower drum parts extends over about 90° relative to the axis. Each of the lower drum parts is pivotal about a respective outside axis parallel to but offset from the main axis. The drum is provided internally with formations impeding axial movement of the wire turns out of the drum while the drum is closed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
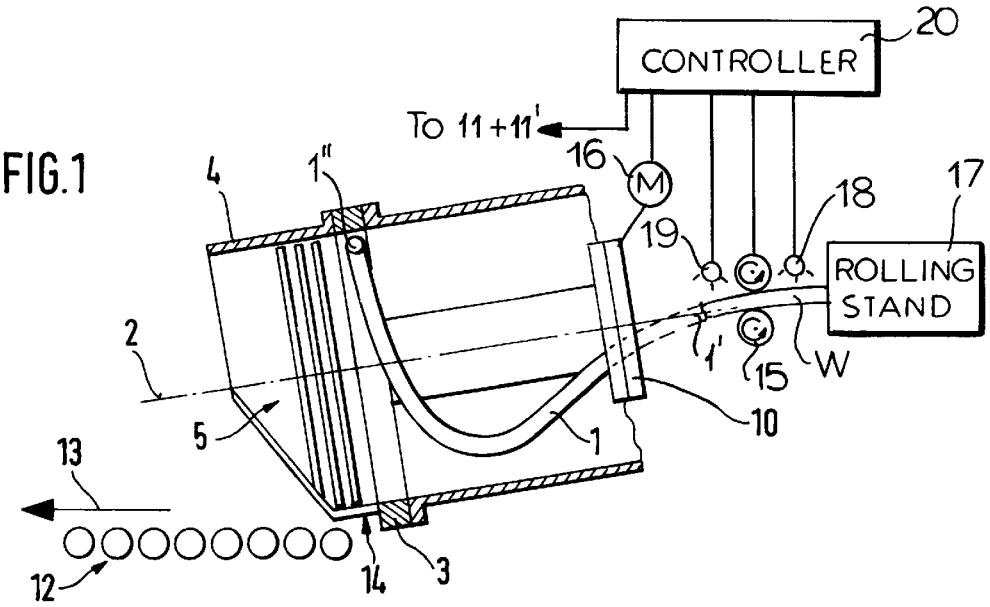
FIG. 1 is a partly diagrammatic side view of the wire-coiling system according to the invention.

As seen in FIG. 1 a coiling apparatus according to the invention has a laying tube 1 bent around an axis 2 and having an upstream end 1' open at the axis 2 and directed axially upstream and a downstream end 1" open offset from the axis 2 and directed tangentially of a circle centered on and lying in a plane perpendicular to the axis 2. The tube 1 is mounted on a support 10 and a motor 16 can rotate this support 10 and the tube 1 about the axis 2 inside a stationary ring 3 centered on the axis 2.

A wire W is fed along the axis 2 from a rolling or drawing stand 17 through a drive 15. A controller 20 is connected to the motor 16 and drive 15 as well as to sensors 18 and 19 respectively located at the outlet of the rolling stand 17 and at the tube end 1' just downstream of the drive 15.

Figure 2:
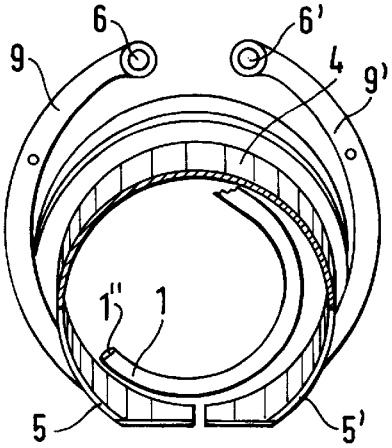
FIG. 2 is an end view of the apparatus of FIG. 1 with the drum closed.
Figure 3:
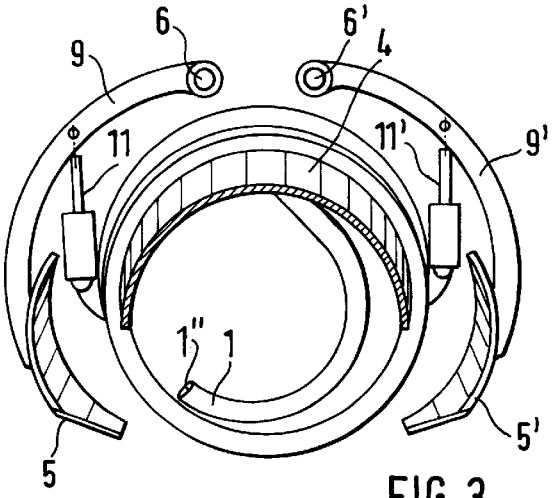
FIG. 3 is a view like FIG. 2 but with the drum open.

A large upper drum part 4 forms an axial extension of 180° of the upper part of the ring 3 and a pair of 90° lower ring parts 5 and 5' can assume a closed position shown in FIG. 2 in which they define a cylindrical inner surface that is centered on the axis 2. The lower parts 5 and 5' are mounted on the lower ends of respective arms 9 and 9' pivotal about respective axes 6 and 6' parallel to and flanking the axis 2 by respective hydraulic double-acting cylinders 11 and 11' so that as shown in FIG. 3 they can be moved into outer positions in which in effect the lower side of the cylindrical space formed by the parts 4, 5, and 5' is downwardly open. The lower and outer ends of the parts 5 and 5' are cut off at an angle at 14 to facilitate exiting of turns of the wire 3 from them.

A support surface 12 formed as a roller conveyor is provide underneath the open downstream end of the device and serves to carry off turns of wire in a transport direction 13.

In use the drive 15 pushes the wire W into the upstream end 1' and it leaves the downstream end in an arcuately bent shape so as to fall in uniform-diameter turns on the surface 12. During normal operation the lower drum parts 5 and 5' are in the open position of FIG. 3 so that the turns can fall unimpeded from the downstream tube end 1" onto the surface 12.

When the sensor 18 or the sensor 19 detects the trailing end of the wire W, the actuators 11 and 11' are operated by the controller 16 after a small delay to swing in the parts 5 and 5', thereby closing the drum 4, 5, 5' downstream of the ring 3. The turns that issue thereafter from the end 1" are held inside this drum 4, 5, 5' to insure that the proper curvature is imparted to them, since normally the advance rate of the wire W increases substantially as its trailing end moves through the tube 1.

Once the trailing end of the wire W leaves the tube 1, the parts 5 and 5' are swung back out as shown in FIG. 3 so as to allow the next piece of wire to be processed in the same manner.

Figure 4:
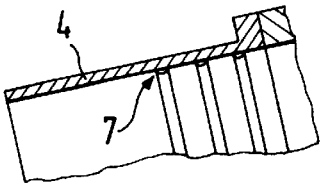
FIG. 4 is a large-scale view of a detail of FIG. 1.
Figure 5:
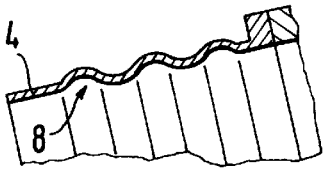
FIG. 5 is a view like FIG. 4 of a variant on the system in accordance with the invention.

In order to impede axial movement of turns through the drum 4, 5, 5' in its closed condition, the drum's inner surface is formed with formations which can be constituted as axially spaced annular ridges 7 as shown in FIG. 4 or this surface can be corrugated annularly as shown at 8 in FIG. 5. Either way these formations 7 or 8 impede axial movement of the turns to ensure that they are properly formed even at the trailing end of the wire which is normally moving faster than the rest of the wire. The extra friction posed to the wire W by the drum 4, 5, 5' slows it down in this critical trailing-end region.

The controller 20 monitors the positions of the ends of the wire W as well as its advance speed. It operates the actuators 11 and 11' with a time delay whose length is determined by the wire advance speed and the spacing between the downstream end of the stand 17 and the upstream end 1' of the tube 1 or the drive 15 to determine when the drum parts 5 and 5' should be swung into the closed position of FIG. 2.

Of course it is within the scope of the invention to have more or less than three parts to form the shaping drum. The parts can move pivotally as shown or purely radially.

We claim:

1. A method of coiling wires comprising the steps of:

rotating about a main axis a curved laying tube having an upstream end opening generally at the axis and directed axially upstream and a downstream end opening radially offset from the axis and directed generally tangentially;

feeding a leading end of the wire into the tube upstream end opening so that the wire issues from the downstream end opening of the tube in a curved condition and is laid in a succession of turns on a surface below the downstream end opening;

detecting passage of a trailing end of the wire through the laying tube;

closing around the downstream end opening of the tube a drum having an inner surface directed toward and centered on the axis at the tube downstream end opening and thereby confining the wire inside the drum as passage of the trailing end through the laying tube is detected; and opening the drum from around the downstream end opening of the tube after passage of the trailing end through the tube and maintaining the drum open until detection of passage of another trailing end through the tube.

2. The wire-coiling method defined in claim 1, further comprising the step of impeding the wire from exiting from the drum until the trailing end of the wire has left the downstream end opening of the tube.

3. The wire-coiling method defined in claim 1, further comprising the step of displacing the surface horizontally as the wire turns are laid on it.

4. An apparatus for coiling wires, the apparatus comprising:

a curved laying tube having an upstream end opening generally at a main axis and directed axially upstream and a downstream end opening radially offset from the axis and directed generally tangentially;

means for rotating the tube about the axis;

drive means for feeding a leading end of the wire into the tube upstream end opening so that the wire issues from the downstream end opening of the tube in a curved condition and is laid in a succession of turns on a surface below the downstream end opening;

sensor means for detecting passage of a trailing end of the wire through the laying tube;

a closable and openable drum having an inner surface directed toward and centered on the axis at the downstream tube end opening; and means for closing the drum around the downstream end opening of the tube and thereby confining the wire inside the drum as passage of the trailing end through the laying tube is detected and for opening the drum from around the downstream end opening of the tube after passage of the trailing end through the tube and maintaining the drum open until detection of passage of another trailing end through the tube.

5. The wire-coiling apparatus defined in claim 4 wherein the axis is inclined downward from the tube upstream end opening and the drum includes a stationary large upper part;

a pair of movable lower parts; and actuator means for pivoting the lower parts between a closed inner position defining a radially outwardly closed space around the tube downstream end opening and an open outer position in which the space is open downward toward the surface.

6. The wire-coiling apparatus defined in claim 5 wherein the large upper drum part extends over about 180° relative to the axis and each of the lower drum parts extends over about 90° relative to the axis.

7. The wire-coiling apparatus defined in claim 5 wherein each of the lower drum parts is pivotal about a respective outside axis parallel to but offset from the main axis.

8. The wire-coiling apparatus defined in claim 5 wherein the drum is provided internally with formations impeding axial movement of the wire turns out of the drum while the drum is closed.

* * * * *